United States Patent [19]

Fowlkes et al.

[11] Patent Number: 4,796,047

[45] Date of Patent: Jan. 3, 1989

[54] ROLLER TRANSFER APPARATUS HAVING AN EXTENDED NIP EXHIBITING LOW PRESSURE

[75] Inventors: William Y. Fowlkes, Fairport; Theodore H. Morse, Rochester; Robert C. Storey, Penfield; James F. Paxon, Rochester, all of N.Y.

[73] Assignee: Eastman Kodak Company, Rochester, N.Y.

[21] Appl. No.: 40,388

[22] Filed: Apr. 20, 1987

Related U.S. Application Data

[63] Continuation-in-part of Ser. No. 29,006, Mar. 23, 1987, abandoned, which is a continuation of Ser. No. 867,179, May 27, 1986, abandoned.

[51] Int. Cl.[4] ..... G03G 15/16

[52] U.S. Cl. ..... 355/3 TR; 355/3 R; 355/3 BE; 355/14 TR

[58] Field of Search ..... 355/3 TR, 14 TR, 16, 355/3 BE, 3 CH, 3 R

[56] References Cited

U.S. PATENT DOCUMENTS

| | | | |
|---|---|---|---|
| 3,781,105 | 12/1973 | Meagher | 355/3 TR |
| 3,942,888 | 3/1976 | Maksymiak et al. | 355/3 R |
| 4,063,724 | 12/1977 | Suda | 271/277 |
| 4,114,536 | 9/1978 | Kaneko et al. | 355/3 BE X |
| 4,407,580 | 10/1983 | Hashimoto et al. | 355/3 TR |
| 4,435,067 | 3/1984 | Draai et al. | 355/3 TR |
| 4,537,494 | 8/1985 | Lubinsky et al. | 355/3 BE X |
| 4,566,781 | 1/1986 | Kuehnle | 355/3 BE X |
| 4,607,935 | 8/1986 | Kindt et al. | 355/3 TR |
| 4,641,956 | 2/1987 | Seanor | 355/3 BE X |

*Primary Examiner*—A. C. Prescott

*Attorney, Agent, or Firm*—Lawrence P. Kessler

[57] ABSTRACT

Roller transfer apparatus of simplified construction which has an extended transfer nip exhibiting low pressure for effecting efficient transfer of marking particle images from a dielectric support with a substantial reduction in image transfer defects. In such transfer apparatus, the dielectric support in the form of a web is supported by a mechanisnm offset relative to the transfer roller in an upstream and/or downstream direction to position the web relative to the transfer roller to establish an extended contact nip zone with a low nip pressure. As an example, the support mechanism includes a pair of spaced rollers respectively offset relative to the transfer roller in an upstream and downstream direction to provide a nip zone with a dimension of at least 0.01 m measured in the direction of roller rotation and a nip pressure in such zone of less than $2\times10^4$ Pa.

14 Claims, 2 Drawing Sheets

FIG. 1a
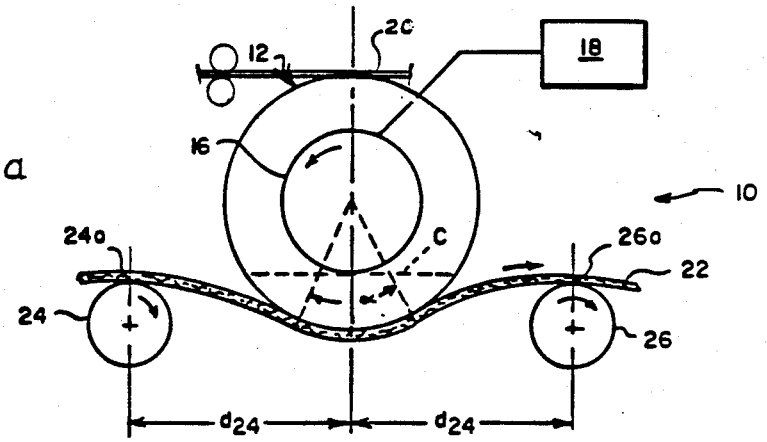
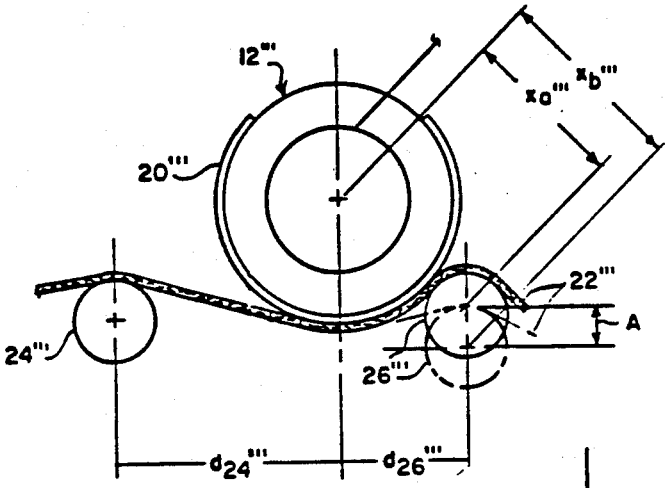
FIG. 4
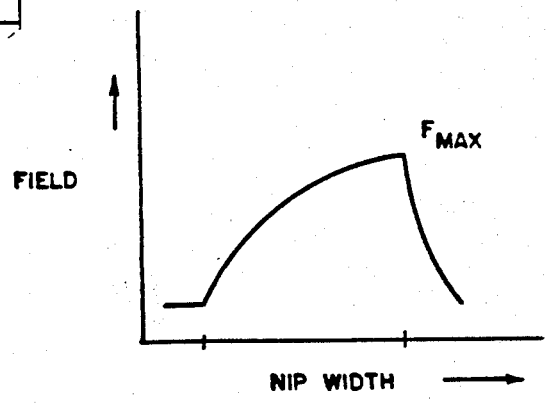
FIG. 5

ROLLER TRANSFER APPARATUS HAVING AN EXTENDED NIP EXHIBITING LOW PRESSURE

RELATED APPLICATION

This is a continuation-in-part of U.S. application Ser. No. 029,006, filed Mar. 23, 1987, which is a continuation of U.S. application Ser. No. 867,179 filed May 27, 1986 now abandoned.

BACKGROUND OF THE INVENTION

This invention relates in general to apparatus for electrically transferring marking particle images from a dielectric support, and more particularly to a roller transfer apparatus for effecting marking particle transfer, such apparatus having an extended transfer nip exhibiting low pressure between the dielectric support and the roller transfer apparatus.

In typical electrographic reproduction apparatus, marking particles are attracted to a latent image charge pattern formed on a dielectric support to develop such image on the support. The dielectric support is then brought into contact with a receiver member and an electric field applied to transfer the marking particle developed image to the receiver member from the dielectric support. After transfer, the receiver member bearing the transferred image is transported away from the dielectric support and the image is fixed to the receiver member by heat and/or pressure to form a permanent reproduction thereon.

Application of the electric field to effect marking particle transfer is generally accomplished by ion emission from a corona charger onto the receiver member, or by supporting the receiver member on an electrically biased roller holding the member against the dielectric support. While roller transfer apparatus are inherently more complex than corona charger transfer apparatus, roller transfer apparatus offer certain advantages. For example, roller transfer apparatus typically require a lower energy budget, and also maintain a more positive (physical) control over receiver members particularly where a member must be recirculated to have multiple images transferred thereto such as in making multicolor reproductions.

A well known alternate method for electrographic reproduction involves the use of a transfer intermediate. According to this method, a marking particle developed image on the dielectric support is transferred by an electric field to an intermediate member (roller or web) and thereafter transferred by an electric field to a receiver member at a location remote from the zone of transfer of the image to the intermediate member. This method is suitable for sequential transfer of a plurality of images, in register, to the intermediate member prior to transfer of any of the images from the intermediate member to the receiver member. Thus, the plurality of images can be transferred to the receiver member in one step to assure that their relative registration is maintained. Of course, for efficient operation, this method requires more effective cleaning of the intermediate member between transfer to the receiver member.

In the use of roller transfer apparatus, image defects, generally referred to as "halo", "hollow character", and "image disruption" have been found to occur particularly when using smooth paper as the receiver member. Studies have indicated that the strength of the transfer field, receiver member characteristics, and marking particle size all have an impact on the production of such defects. Additionally, the "hollow character" defect is due to the adhesion of the marking particles to each other and to the dielectric support when the receiver member is compressed with the dielectric support by the transfer roller. That is to say, the "hollow character" defect is related, at least in part, to the pressure in the transfer nip, and a substantial reduction in this defect is found to occur when the nip pressure is reduced. For example, U.S. Pat. No. 3,942,888 (issued Mar. 9, 1976, in the name of Maksymiak et al), in addressing the "hollow character" defect, discloses a transfer roller apparatus configured to function at a nip pressure below $6.9\times10^3$ Pa in order to reduce such defect. However, the roller disclosed in this patent has a complex construction including enlarged end portions which serve to provide a gap between the lesser diameter central portion and the dielectric member. As is apparent, a transfer roller of this construction must be capable of being selectively shimmed to successfully function to maintain desired pressure on a variety of receiver member thicknesses.

SUMMARY OF THE INVENTION

The present invention is directed to roller transfer apparatus of simplified construction which has an extended transfer nip exhibiting low pressure for effecting efficient transfer of marking particle images from a dielectric support with a substantial reduction in image transfer defects. In such transfer apparatus, the dielectric support in the form of a web is supported by a mechanism offset relative to the transfer roller in an upstream and/or downstream direction to position the web relative to the transfer roller to establish an extended contact nip zone with a low nip pressure. As an example, the support mechanism includes a pair of spaced rollers respectively offset relative to the transfer roller in an upstream and downstream direction to provide a nip zone with a dimension of at least 0.01 m measured in the direction of roller rotation and a nip pressure in such zone of less than $2\times10^4$ Pa. The arrangement of this transfer apparatus also provides improved receiver member handling characteristics and more efficient transfer field production.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 1*a* is a side elevational view of the transfer apparatus according to this invention wherein the transfer apparatus is an intermediate member;

FIG. 4 is a side elevational view of another embodiment of the transfer apparatus according to this invention; and FIG. 5 is a graphical representation showing the effective electrostatic field as a function of width of the transfer nip.

DESCRIPTION OF THE PREFERRED EMBODIMENTS

Figure 1:
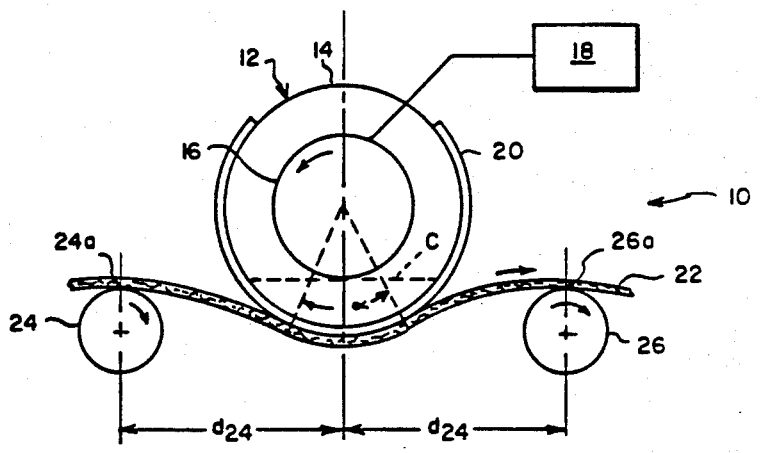
FIG. 1 is a side elevational view of the transfer apparatus according to this invention.

Referring now to the accompanying drawings, FIG. 1 shows a transfer apparatus designated generally by the numeral 10. The transfer apparatus includes a rotatable transfer roller 12 comprising a cylindrical semi-insulating layer 14 mounted on a conductive core 16. An example of a semi-insulating layer 14 that will work with this invention is polyurethane with a bulk resistivity in the range of between $10^9$ to $10^{10}$ ohm centimeters. The conductive core 16 can be formed of aluminum, for example. A potential source 18 is electrically coupled to the core 16.

A dielectric support, such as web 22, is movable in operative relation with the transfer roller 12. The web 22 includes, for example, a layer of photoconductive material and a grounded support layer such as shown in U.S. Pat. No. 3,615,414, issued Oct. 26, 1971, in the name of Light. By any well known electrographic process, a marking particle image (or plurality of successive images) is formed on the web 22. The marking particle image, or successive images, is transferred by the apparatus 10 to a receiver member 20 supported on the peripheral surface of the transfer roller 12 by any suitable mechanism (not shown), such as vacuum or mechanical clamps. For transfer of a single image, the receiver member travels with the roller for at least a portion of its rotation; and for transfer of multiple successive images, the receiver member remains in supported relation of the roller surface and is recirculated by roller rotation into transfer relation with the web 22 a number of times corresponding to the number of successive images to be transferred to the receiver member. Of course, as discussed above, the transfer apparatus 10 can be an intermediate member which has marking particle image(s) transferred directly thereto with subsequent transfer to a receiver member (see FIG. 1*a*).

The transfer apparatus 10 includes back-up rollers 24, 26 which serve to support and direct the web into transfer relation with the transfer roller 12. The positional mounting of the rollers 24 and 26 are of particular importance in providing an extended transfer nip between the web 22 and the transfer roller 12, such nip exhibiting a sufficiently low pressure in order to prevent image transfer defects from being exhibited upon transfer of a marking particle image from the web to the receiver member. Additionally, such positioning of rollers 24 and 26 aids in certain aspects of receiver member handling. Of course other back-up mechanisms, such as plates or guides for example, are suitable for use with this invention.

To accomplish the desired extended transfer nip of low pressure, the positional mounting of the rollers 24, 26 is as follows. The rollers 24, 26 are offset with respect to the transfer roller 12 (i.e., such rollers are spaced upstream/downstream of the transfer roller with their respective axes substantialy parallel to the axis of the transfer roller). Further, such rollers are located so that a plane tangent to the rollers at the points (eg. 24*a*, 26*a* of FIG. 1) at which the web would be supported with the transfer roller 12 removed, passes through the roller 12 along a chord c thereof. The web 22 thus has a wrap angle $\alpha$ about the roller 12 to establish the extended transfer nip therebetween. The pressure in the extended nip is equal to the normal force of the roller 12 on the web 22, divided by the nip area according to the equation:

$$P = \frac{F_n}{(N_W)(R_L)}$$

where

P=pressure in Pa;

$F_n$=normal force in N;

$N_W$=nip width in m;

$R_L$=roller length in m.

When the roller 12 is otherwise unsupported, such normal force is equal to the vertical component of the weight of the roller 12. In the case where such roller is immovably supported at its ends, the nip pressure is directly related to the tension in the web according to the equation:

$$P = \frac{T}{R}$$

where

P=pressure in Pa;

T=tension in N per linear m;

R=radius of curvature in m.

By adjustment of the normal force (roller weight or tension on the web), nip width, or linear distance of roller/web contact, the transfer pressure can be set to a suitable level to avoid image transfer defects. Such pressure may be in the range of about $3.45\times10^3$ to $3.45\times10^4$ Pa, and is ideally maintained below $2\times10^4$ Pa. Several examples of geometric relationships for the transfer apparatus 10 according to this invention which have successfully reduced image transfer defects are shown in the following Table No. 1.

TABLE NO. 1

| Back-up Roller Offset ($d_{24}$ or $d_{26}$) (m) | Transfer roller Weight (kgs) | Transfer Nip Width (m) | Nip Pressure (Pa/$10^3$) |
|---|---|---|---|
| .051 | 2.025 | .016 | 5.04 |
| .051 | 4.725 | .028 | 6.76 |
| .038 | 2.025 | .021 | 4.35 |
| .038 | 4.725 | .033 | 5.73 |
| .025 | 2.025 | .021 | 3.73 |
| .025 | 4.725 | .022 | 8.56 |
| .013 | 2.025 | .010 | 7.59 |
| .013 | 4.725 | .011 | 17.9 |

The extended nip width over the wrap angle $\alpha$ and the low pressure in such nip provide a substantial advantage in reducing the "halo" and "hollow character" image transfer defects. This is believed to be due to the ability of obtaining a high electrostatic transfer field with a relatively low potential source with the extended nip, and the reduction of adhesion of the marking particles to each other and to the web 22 as a result of the low pressure in such nip. For example, Table No. 2 shows the relationship between the potential required for efficient transfer and nip width for a 0.015 m diameter roller having a bulk resistivity of $6\times10^9$ ohm centimeters in the low pressure arrangement according to this invention.

TABLE NO. 2

| Nip Width (m) | Potential Volts |
|---|---|
| 0.004 | 3250 ± 250 |

TABLE NO. 2-continued

| Nip Width (m) | Potential Volts |
|---|---|
| 0.007 | 2250 ± 250 |
| 0.011 | 2500 ± 500 |

Further, Table No. 3 shows the effect of pressure in the extended transfer nip on the production of "hollow character" defect for certain types of receiver members (paper).

TABLE NO. 3

| | Pressure (Pa/$10^3$) | | | | | |
|---|---|---|---|---|---|---|
| Paper Type | 3.73 | 8.28 | 24.2 | 36.5 | 66.2 | 94.5 |
| Husky Bond TM | None | None | None | None | Little | Yes |
| Potlatch Vintage Velvet TM | None | None | None | None | Yes | Yes |
| Potlatch Vintage Gloss TM | Little | Little | Yes | Yes | Yes | Yes |

With regard to the electric transfer field, for a semi-insulating transfer roller ($10^9$–$10^{10}$ ohm centimeters), as shown in FIG. 5, the electric field F starts to build up at the point of initial contact of the web 22 with the transfer roller 12. The field continues to build to a maximum $F_{max}$ which occurs when the web separates from the transfer roller, at which point the field rapidly decays. The field maximum $F_{max}$ must be at a level which provides for effective, substantially complete, transfer of the marking particle image from the web 22 to the receiver member 20. As is apparent, for a given potential source and transfer roller geometry, the field maximum $F_{max}$ is directly related to the width of the transfer nip. Therefore, for a given nip width, a particular $F_{max}$ may be more efficiently produced (i.e. $F_{max}$ reached with a lower output potential source). As a result efficient transfer of the marking particles is obtained with reduction in image defects such as "halo" and without a pre-nip ionization which might induce other types of image defects. Of course, the extended nip, low pressure arrangement of the transfer apparatus 10 according to this invention is also suitable for use with conductive rollers (i.e. bulk resistivity of less than $10^9$ ohm centimeters). The extended nip, with a dimension measured in the direction of rotation of the transfer roller 12, for a transfer roller having a semi-insulating layer in the above-noted resistivity range, is optimally in the range of about 0.0125±0.0025 m. Of course for more insulative transfer rollers the nominal value of the nip width is higher, and for more conductive transfer rollers the nominal value is lower.

Figure 2:
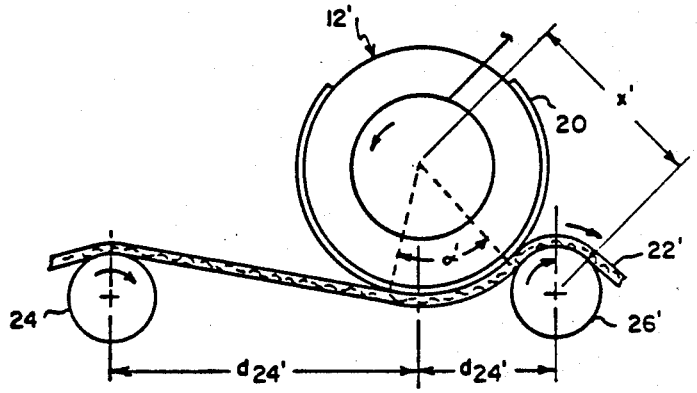
FIG. 2 is a side elevational view of an alternate embodiment of the transfer apparatus according to this invention.
Figure 3:
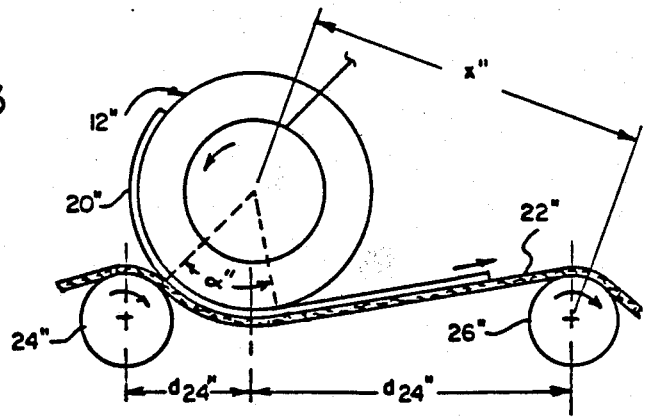
FIG. 3 is a side elevational view of another alternate embodiment of the transfer apparatus according to this invention.

The transfer roller 12 may be positioned with respect to the rollers 24 and 26 in the direction of travel of the web 22 at alternate locations such as shown in the embodiments of FIGS. 2–4. The elements of these figures which are similar to elements of FIG. 1 are designated by prime numerals. In FIG. 2, the transfer roller 12' is shifted toward the roller 26'. Thus in measuring the distances between parallel planes through the respective axes of rotation of the rollers 24' and 26' and the transfer roller 12', the distance $d_{26'}$ is substantially less than the distance $d_{24'}$. Moreover, the distance x' measured between the axes of the transfer roller 12' and the roller 26' is substantially equal to the sum of the radii of the rollers plus the thicknesses of the web 22' and the receiver member 20'. This results in a more sharply defined separation of the receiver member 20' from the web 22', over that found in FIG. 1, as the receiver member recirculates with the transfer roller 12'. This sharp separation aids in preventing the receiver member from prematurely detacking from the transfer roller and following the web.

In FIG. 3, the transfer roller 12'' is shifted toward the roller 24''. Thus in measuring the distances between parallel planes through the respective axes of rotation of the rollers 24'' and 26'' and the transfer roller 12'', the distance $d_{26''}$ is substantially greater than the distance $d_{24''}$. Moreover, the distance x'' is substantially greater than the sum of the radii of the transfer roller 12'' and roller 26''. With this arrangement, upon detack of the receiver member 20'' from the transfer roller 12'' at the completion of transfer, the receiver member more readily follows the web 22'' because the span of the web toward the roller 26'' does not define such a sharp separation therebetween. Moreover, with the receiver member following the web, the transferred (but unfused) image is trapped between the detacked receiver member and the web. Accordingly, this trapping action prevents potential image disruptions due to post nip ionization forces acting on the marking particles which would, if not trapped, be free to move relative to their image-wise configuration.

Of course, other alternate embodiments of the transfer apparatus 10 according to this invention are possible by, for example, selectively combining the embodiments of FIGS. 2 and 3. That is to say, at selected times (e.g. during recirculation of the receiver member or during detack), the relative location of the transfer roller to the web back-up rollers may be shifted to obtain the benefits of each arrangement. A still further embodiment based on the teachings of the embodiments of FIGS. 2 and 3 is shown in FIG. 4. In FIG. 4, the distance $d_{26'''}$ is substantially less than the distance $d_{24'''}$ (similar to the arrangement shown in FIG. 2). However, the roller 26''' is supported for relative movement in the direction of arrow A to effect a change in the distance between the axes of the transfer roller and the back-up roller (i.e., $x_{a'''}$ and $x_{b'''}$). Thus the sharpness of separation between the web and the receiver member may be optimally set to selectively inhibit or enhance detack of the receiver member from the transfer roller as described above.

The invention has been described in detail with particular reference to preferred embodiments thereof, but it will be understood that variations and modifications can be effected within the spirit and scope of the invention.

We claim:

1. In a transfer apparatus for transferring a marking particle image from a dielectric web under the influence of an electric field, the improvement comprising:

a dielectric web support, said support including means offset relative to said transfer apparatus in an upstream and/or downstream direction for positioning said dielectric web relative to said transfer apparatus to establish an extended contact nip zone and a low nip pressure in such zone.

2. The invention of claim 1 wherein said nip pressure is less than $2\times10^4$ Pa.

3. The invention of claim 1 wherein said extended contact nip zone has a dimension in the direction of web travel of at least 0.010 m.

4. In a transfer apparatus for transferring a marking particle image from a dielectric web to a receiver member backed by a transfer roller, under the influence of an electric field, the improvement comprising:

a dielectric web support, said support including means offset relative to said transfer roller in an upstream and/or downstream direction for positioning said dielectric web relative to said transfer roller to establish an extended contact nip zone and a low nip pressure in such zone.

5. The invention of claim 4 wherein said nip pressure is less than $2\times10^4$ Pa.

6. The invention of claim 4 wherein said extended contact nip zone has a dimension in the direction of web travel of at least 0.010 m.

7. The invention of claim 4 wherein positioning means includes a pair of spaced rollers mounted on the opposite side of said dielectric web from said transfer roller and with the axis thereof substantially parallel to the axis of said transfer roller, one of said pair of spaced rollers being upstream of said transfer roller and the other of said pair of spaced rollers being downstream of said transfer roller, and wherein a plane tangent to each of said pair of spaced rollers passes through said transfer roller along a chord thereof.

8. The invention of claim 7 wherein the distances between parallel planes, passing through the respective axes of said pair of rollers and said transfer roller perpendicular to said chord or an extension thereof, are substantially equal.

9. The invention of claim 7 wherein said downstream roller of said pair of rollers is movable in a plane whereby the sharpness of separation between said dielectric web and a receiver member is optimally adjusted to inhibit or enhance detack of the receiver member from said transfer roller.

10. The invention of claim 7 wherein the distance between parallel planes, passing through the axis of the upstream roller of said pair of rollers and the axis of said transfer roller perpendicular to said chord or an extension thereof, is greater than the distance between parallel planes, passing through the axis of the downstream roller of said pair of rollers and the axis of said transfer roller perpendicular to said chord or an extension thereof.

11. The invention of claim 7 wherein the distances between substantially vertical, parallel planes through the axis of the downstream roller of said pair of rollers and the axis of said transfer roller is greater than the distance between substantially vertical, parallel planes through the axis of the upstream roller of said pair of rollers and the axis of said transfer roller.

12. The invention of claim 7 wherein said spaced rollers are selectively movable in a plane containing the axes thereof, whereby the sharpness of separation between said dielectric web and a receiver member is optimally adjusted to inhibit or enhance detack of the receiver member from said transfer roller.

13. Transfer apparatus for transferring a plurality of marking particle images successively from a dielectric web to a receiver member under the influence of an electric field, said transfer apparatus comprising;

a transfer roller, said roller including means for selectively tacking a receiver member to the peripheral surface thereof; and a dielectric web support, said support including a pair of spaced rollers mounted on the opposite side of said dielectric web from said transfer roller and with the axes thereof substantially parallel to the axis of said transfer roller, one of said pair of rollers being upstream of said transfer roller and the other being downstream of said transfer roller, and wherein a plane tangent to each of said pair of spaced rollers passes through said transfer roller along a chord thereof, said pair of spaced rollers being selectively movable in a plane containing the axes thereof whereby the sharpness of separation between said dielectric web and a receiver member on said transfer roller is increased to inhibit detack of the receiver member from said transfer roller during transfer of all but the last of such successive marking particle images, and the sharpness of separation between said dielectric web and receiver member is decreased during transfer of the last of such successive marking particle images to enhance separation of the receiver member from said transfer roller.

14. Transfer apparatus for transferring a plurality of marking particle images successively from a dielectric web to said transfer apparatus and thence to a receiver member under the influence of an electric field, said transfer apparatus comprising;

a transfer roller;

a dielectric web support, said support including a pair of spaced rollers mounted on the opposite side of said dielectric web from said transfer roller and with the axes thereof substantially parallel to the axis of said transfer roller, one of said pair of rollers being upstream of said transfer roller and the other being downstream of said transfer roller, and wherein a plane tangent to each of said pair of spaced rollers passes through said transfer roller along a chord;

electric field producing means for transferring such plurality of marking particle images in registered superimposition to said roller; and means for operatively associating a receiver member with said transfer roller to enable said plurality of marking particle images to be transferred to said receiver member.

* * * * *